US007377274B2

(12) United States Patent
Morikawa et al.

(10) Patent No.: US 7,377,274 B2
(45) Date of Patent: May 27, 2008

(54) RAPID-FIRING TOY GUN

(75) Inventors: Evan Takashi Morikawa, Rancho Santa Fe, CA (US); Patrick James Moore, San Diego, CA (US)

(73) Assignee: High Tech High Foundation, San Diego, CA (US)

( * ) Notice: Subject to any disclaimer, the term of this patent is extended or adjusted under 35 U.S.C. 154(b) by 112 days.

(21) Appl. No.: 10/845,058

(22) Filed: May 12, 2004

(65) Prior Publication Data

US 2005/0252500 A1 Nov. 17, 2005

(51) Int. Cl.
*F41B 11/02* (2006.01)

(52) U.S. Cl. ..... 124/71; 124/72; 124/49; 124/63

(58) Field of Classification Search ..... 15/334; 124/72, 56, 63, 41.1, 49, 60, 67, 82
See application file for complete search history.

(56) References Cited

U.S. PATENT DOCUMENTS 1,673,945 A * 6/1928 Littlefield ..... 124/26
3,388,696 A * 6/1968 Hoverath et al. ..... 124/62
3,731,421 A 5/1973 Frattolillo et al.
3,911,888 A * 10/1975 Horvath ..... 124/56
4,086,902 A * 5/1978 Reynolds ..... 124/61
4,430,821 A * 2/1984 Vincent ..... 42/50
4,461,055 A * 7/1984 Zerrer et al. ..... 15/344
4,586,482 A 5/1986 Di Pietro
4,884,314 A * 12/1989 Miner et al. ..... 15/344
5,251,906 A * 10/1993 Heller et al. ..... 273/397
5,323,755 A 6/1994 Hsieh
5,429,108 A 7/1995 Hsieh
5,507,271 A * 4/1996 Actor ..... 124/56
5,887,578 A * 3/1999 Backeris et al. ..... 124/49
6,181,032 B1 * 1/2001 Marshall et al. ..... 307/150
6,276,353 B1 * 8/2001 Briggs et al. ..... 124/71

(Continued)

FOREIGN PATENT DOCUMENTS

EP 0 772 022 A1 5/1997

*Primary Examiner*—Michael J. Carone
*Assistant Examiner*—Stewart T Knox
(74) *Attorney, Agent, or Firm*—Cooley Godward Kronish LLP

(57) ABSTRACT

An automatic, rapid-firing toy gun is powered by a fast moving air stream. The toy gun is simple in design and does not require a lot of effort and time to fire the projectiles or to load the projectiles between firing. The toy gun includes a barrel, a fan, a loading chamber, and a trigger. The barrel has a forward end, a rear end, and an inner passage between the two ends. The fan is arranged with respect to the barrel to direct an air stream through the inner passage from the rear end to the forward end. The loading chamber is mounted on the barrel and has an opening directed into the inner passage. The loading chamber is sized and shaped to hold a plurality of projectiles and the opening is sized and shaped to sequentially release the plurality of projectiles into the inner passage of the barrel one at a time. The trigger is electrically connected to the fan. Pulling the trigger causes the fan to drive a large volume of air through the gun barrel and the air stream to accelerate as it travels through a narrow passage of the gun barrel. Projectiles sequentially fall into the air stream one at a time and are quickly released from the gun as the air stream accelerates through the gun barrel and exits the gun barrel.

11 Claims, 6 Drawing Sheets

U.S. PATENT DOCUMENTS 6,637,069 B2 * 10/2003 Marshall et al. ..... 15/405
6,644,294 B2 * 11/2003 Christensen ..... 124/77
6,807,959 B1 * 10/2004 Murdock et al. ..... 124/61
2003/0024519 A1 2/2003 Chen
2005/0252500 A1 * 11/2005 Morikawa et al. ..... 124/71

* cited by examiner

RAPID-FIRING TOY GUN

FIELD OF THE INVENTION

The present invention relates to a toy gun and more specifically relates to a rapid-firing toy gun that is powered by a fast-moving air stream.

BACKGROUND OF THE INVENTION

Efforts have been made to develop toy guns that are capable of firing, at distal targets, multiple projectiles in rapid succession. Given that such toy guns are typically handled by children, it has also been desired that such toy guns be simple to use. In addition, in order to reduce manufacturing costs, attempts have been made to minimize design complexity. A number of toy guns in the marketplace aim to achieve one or more of these objectives.

Air-powered guns, such as Nerf® Powerclip manufactured by Hasbro, Inc., are capable of shooting each projectile quickly and hitting a target with a great force. Air-powered guns are powered by compressed air that is manually pumped up to pressure. Although once pumped the gun is able to shoot multiple projectiles fairly quickly, before shooting each group of projectiles the gun must be pumped up to establish sufficient pressure to propel the projectiles. Unfortunately, this tends to consume relatively substantial amounts of time and energy. Certain air-powered guns are known to require a dozen or more "pumps" before the first dart can be fired. In addition, certain such guns further require that each projectile needs to be individually loaded at the front of the gun, which increases loading time relative to other approaches.

Spring-powered guns are also capable of shooting projectiles at a long distance and with a great force. Spring-powered guns use the spring loaded force to propel the projectiles forward. Spring powered guns, however, cannot provide a fully automatic mode of firing, because each projectile needs to be spring loaded and released one at a time in order to gain sufficient power for the projectile to be propelled forward.

Other toy guns, such as Nerf® Motorized Ballzooka MP 150, available from Hasbro, Inc., are powered by motorized conveyor belts. The motor used in these guns takes a long time to warm up to reach the maximum rotation speed. In addition, it is generally believed that the balls shot by these guns can only be delivered one at a time. Specifically, it is typically the case that once the first ball is fired, a spinning wheel forming part of the motorized conveyor belt responsible for propelling the ball to be fired tends to slow down a bit. Unfortunately, this requires that a delay occur prior to attempting to fire the next ball from the gun at optimal speed, thereby limiting the maximum firing rate capable of being achieved.

Motorized disk shooters are other examples of toy guns. These guns use a fan to shoot small doughnut-shaped disks out of the front ends of the guns. Disk shooters tend to be accurate and to require very little energy to fire. However, only one disk is released at a time when the trigger is pulled. In addition, existing disk shooters do not provide a very long firing range, as they tend to lack the necessary aerodynamic qualities and sufficiently powerful motors.

SUMMARY OF THE INVENTION

In one aspect, the invention features a toy gun which includes a barrel, a fan, a loading chamber, and a trigger. The barrel has a forward end, a rear end, and an inner passage between the two ends. The fan is arranged with respect to the barrel to direct an air stream through the inner passage from the rear end to the forward end. The loading chamber is mounted on the barrel and has an opening directed into the inner passage. The loading chamber is sized and shaped to hold a plurality of projectiles and the opening is sized and shaped to sequentially release the plurality of projectiles into the inner passage of the barrel one at a time. The trigger is electrically connected to the fan.

In one embodiment, the toy gun includes a ducted fan. The ducted fan includes a motor and a battery. The battery is electrically connected to the trigger and the motor. In one implementation, the battery has sufficient power to drive the fan at a speed of greater than 20,000 RPM. In another implementation, the fan generates an air stream sufficient to release the projectiles from the barrel at a rate of greater than 0.5 seconds per projectile.

In one embodiment, the forward end of the barrel is smaller in diameter than the rear end of the barrel. In one example, the diameter of the barrel decreases gradually from the rear end to the front end. In another embodiment, a portion of the inner passage near the fan is divided into multiple passages to even out the air stream directed from the fan.

In one embodiment, the loading chamber is sized and shaped to hold a plurality of cylindrical projectiles in a stacked order. In another embodiment, the loading chamber is sized and shaped to prevent the projectiles from moving upward when the air stream enters the loading chamber through an opening directed into the inner passage of the barrel and forces its way up the loading chamber. The loading chamber may also include an object placed on top of the projectiles, where the object has sufficient weight to prevent the projectiles from moving upward when the air stream enters the loading chamber through the opening and forces its way up the loading chamber. In a particular implementation, the object has at least one opening to let a portion of the air stream flow through and around the object to prevent the object from escaping from the loading chamber when there is excess air stream. In yet another embodiment, the loading chamber is sized and shaped to prevent friction between the projectiles and the loading chamber.

In still another embodiment, the loading chamber and the opening thereof are sized and shaped to release the projectiles into the inner passage of the barrel as a consequence of gravitational force.

In another aspect, the invention features a method for operating a toy gun which includes a barrel having a forward end, a rear end, and a passage therebetween. According to the method, a plurality of projectiles are loaded into a loading chamber mounted on the barrel. In response to a trigger signal, an air stream is directed through the inner passage from the rear end to the forward end, and multiple ones of the plurality of projectiles are sequentially released into the inner passage of the barrel upon generation of the trigger signal.

In one embodiment, a ducted fan arranged with respect to the barrel directs the air stream through the inner passage from the rear end to the forward end. In one example, the ducted fan is driven at a speed of greater than 20,000 RPM. In another embodiment, the air steam is accelerated through the inner passage from the rear end to the forward end. In still another embodiment, the projectiles are sequentially released at a rate of greater than 0.5 seconds per projectile.

DETAILED DESCRIPTION OF EMBODIMENTS OF THE INVENTION

The present invention features an automatic, rapid-firing toy gun that is powered by a fast moving air stream. This toy gun is simple in design and does not require substantial time and effort to fire the projectiles or to load the projectiles between firing. In one aspect of the invention, the toy gun is powered by a fan which generates a fast-moving air stream. Pulling the trigger of the gun causes the fan to drive a large volume of air through the gun barrel and the air stream to accelerate as it travels through a narrow passage of the gun barrel. Projectiles sequentially fall into the air stream one at a time and are quickly released from the gun as the air stream accelerates through the gun barrel and exits the gun barrel. The toy gun of the present invention fires projectiles sequentially at a fast rate with very little effort. For example, certain embodiments of the toy gun are disposed to fire projectiles at about 2-3 rounds per second (i.e., approximately one round every 0.3 to 0.5 seconds).

Figure 1:
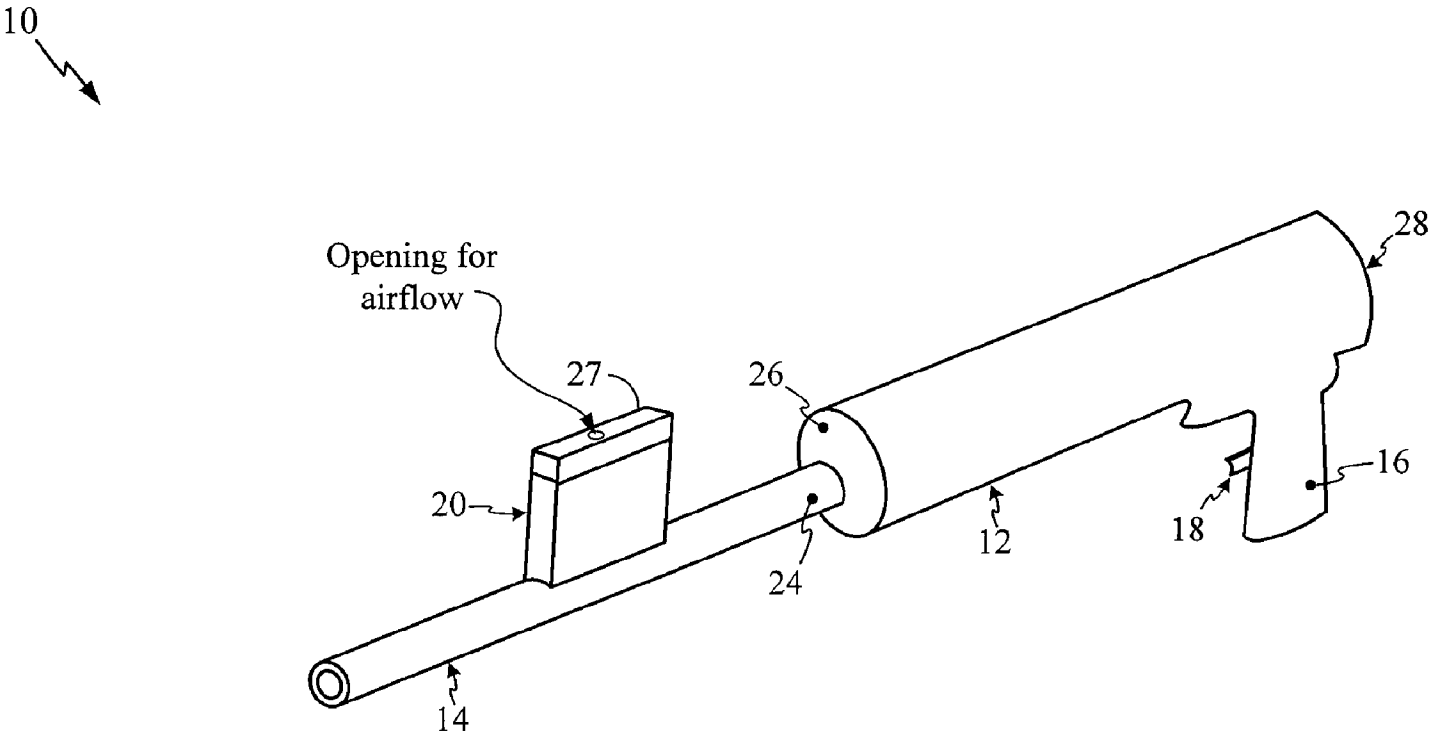
FIG. 1 is a perspective drawing of a toy gun of the present invention.
Figure 2:
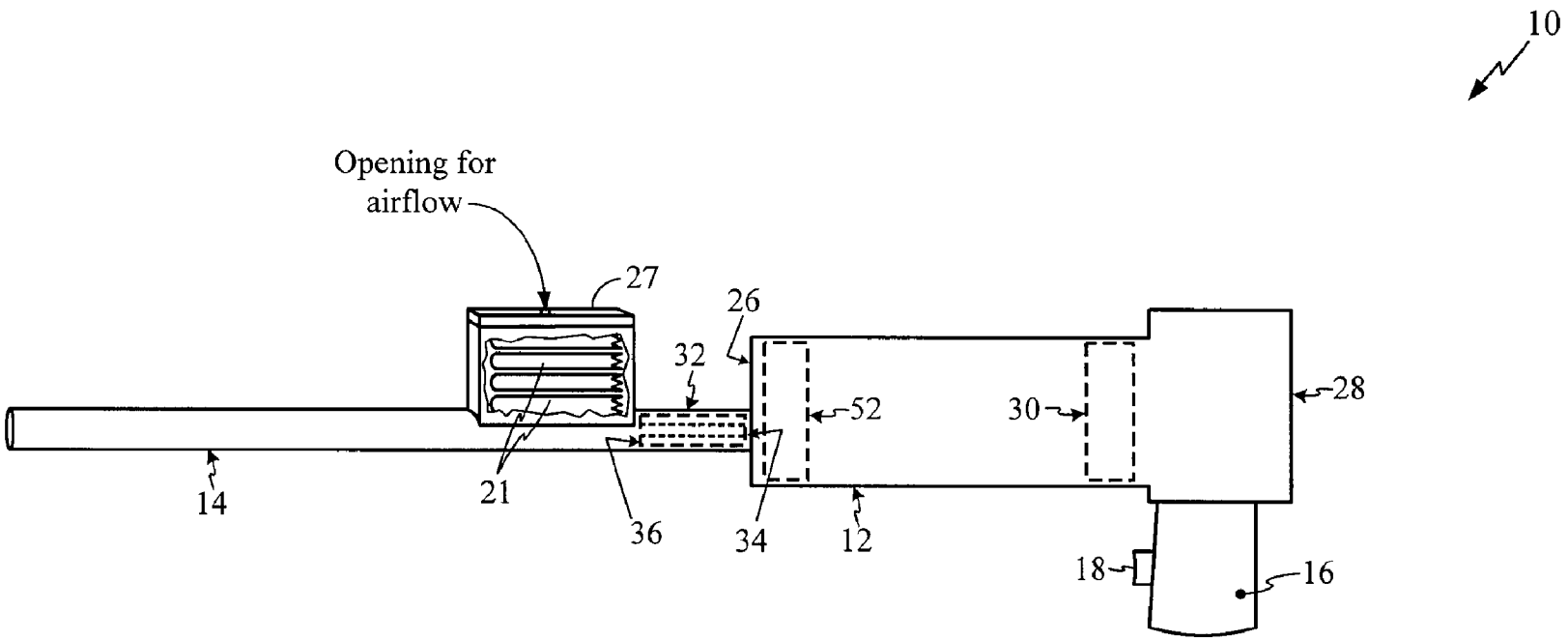
FIG. 2 is a partially transparent side view of the toy gun of the present invention.

Referring to FIGS. 1 and 2, in one embodiment the toy gun (10) includes a first barrel (12), a second barrel (14), a loading chamber (20), a handle (16), and a ducted fan (30). The forward end (26) of the first barrel (12) mates with the rear end (24) of the second barrel (14). The loading chamber (20) is placed above the second barrel (14). The handle (16) is positioned below the first barrel (12) near its rear end (28). The ducted fan (30) is securely positioned inside the first barrel (12) with the intake end facing towards the rear end (28) of the first barrel (12).

Figure 3:
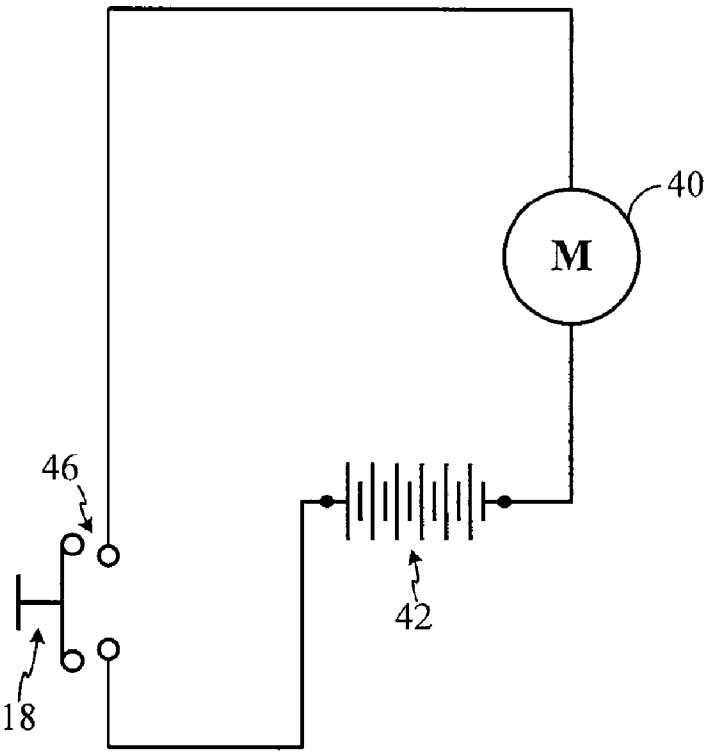
FIG. 3 is a schematic diagram illustrating electrical connection between a battery, a motor, and a switch included in the toy gun.

Referring to the partially transparent side view of FIG. 2 and the schematic diagram of FIG. 3, the ducted fan (30) includes a motor (40) which is electrically connected to a battery (42) and a trigger (18). In one embodiment, the ducted fan (30) comprises a Wattage PowerFan 400/6 EDF unit available from Watt-Age, located at 18480 Bandilier Circle, Fountain Valley, Calif. It is desirable to use a ducted fan (30) with sufficient power to cause the projectiles (21) to accelerate to their maximum speed as they travel through the second barrel (14). The battery (42) powers the ducted fan (30). The battery must provide sufficient current to operate the ducted fun. The battery (42), for example, can be a 9.6 v., 1200 mA/hour rechargeable nickel cadmium battery. This battery (42) is capable of driving the ducted fan (30) at about 20,000 RPM. In one embodiment, the battery (42) is placed in a clip which locks to the gun (10). The trigger (18) is used to activate the fan (30). In the embodiment of FIGS. 1 and 2, the trigger (18) is a push switch which forms an electrical circuit with the battery (42) and the motor (40). For example, the push switch can be rated at 15 Amperes at 12 VDC. Pressing the push switch causes the circuit (46) to close and the motor (40) of the fan (30) to begin operating. The push switch is placed on the handle (16) as shown in FIG. 1 such that the user can easily push it to start the gun (10). Once the trigger (18) is pulled by pushing on the push switch, rapid rotation of the blades of the fan (30) causes a large volume of air to move through the first barrel (12) and the second barrel (14).

A primary purpose of the first barrel (12) is to house the fan (30) and to provide sufficient space for the air stream to begin accelerating. Therefore, the first barrel (12) should be sufficiently large for the fan (30) to securely fit inside. The first barrel (12) may, for example, be constructed using a PVC pipe with a diameter of 3 inches and a length of 12 inches. The dimensions of the first barrel (12) is not critical; however, an inverse relationship exists between its length and the amount of air generated by the ducted fan (30) reaching the second barrel (14). The primary purpose of the second barrel (14) is to generate a fast moving air stream into which the projectiles (21) are carried and thereafter released from the gun (10). The second barrel (14), therefore, should have a smooth inside surface to minimize any friction between the projectiles (21) and the second barrel (14). To perform this function, the lengths of the first barrel (12) and the second barrel (14) need to be carefully selected. If the lengths of the barrels (12, 14) are too long, excessive resistance could be created and the air stream would lose its speed. If the lengths of the barrels (12, 14) are too short, the projectiles (21) do not have sufficient space to sufficiently accelerate.

In one embodiment, the second barrel (14) also has a significantly smaller diameter. In one exemplary embodiment where the projectiles (21) are cylindrical in shape, the second barrel (14) has a circular cross section and has a cross sectional diameter that is slightly larger than the cross sectional diameter of a projectile (21). For example, the diameter of the second barrel (14) may be 3/64 inch to 1/8 inch larger than the diameter of the projectile (21). This ensures that the projectile (21) remains horizontal in orientation while passing through the inner passage of the second barrel (14). For example, where the first barrel (12) is 12 inches in length and 3 inches in diameter and the projectiles are slightly less than 5/8 inch in diameter, the second barrel (14) can be about 27 inches in length and 5/8 inch in diameter.

In one embodiment, the second barrel (14) includes several elongated tubes (32) placed inside the second barrel (14) near its rear end (24). One end (34) of the elongated tubes (32) may be flush with the rear end (24) of the second barrel (14) and the other end (36) of the elongated tubes (32) may be flush with a rear edge (37) of an opening (22) in the second barrel (14) through which the projectiles (21) are received. Placement of the elongated tubes (32) substantially as described herein evens the air flow through the second barrel (14). The elongated tubes (32) may be realized using, for example, straws of approximately 1 inch in length and 0.25 inches in diameter, or functionally equivalent tubular structures.

In one embodiment, the rear end (24) of the second barrel (14) and the forward end (26) of the first barrel (12) form a tight seal to prevent any air leakage between the two barrels (12, 14). The formation of such a seal may be facilitated by the placement, inside the forward end (26) of the first barrel (12), of a wooden disk (52) defining an opening of approximately the same diameter as the second barrel (14). Such a seal may be further enhanced by slotting the rear end (24) of the second barrel (14) within an opening defined at the forward end (26) of the first barrel (12).

Figure 4:
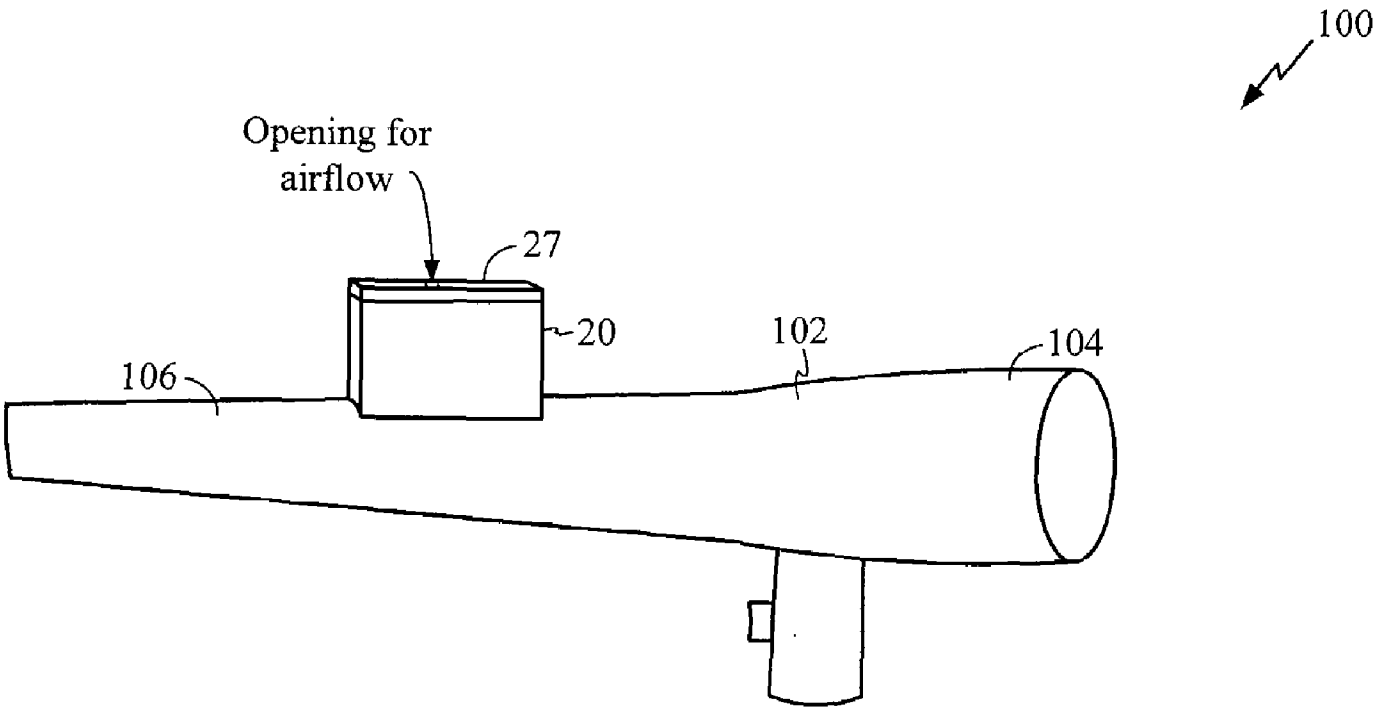
FIG. 4 is a perspective drawing of another embodiment of a toy gun of the present invention.

Referring to FIG. 4, in another embodiment, the toy gun (100) includes a single funnel-shaped barrel (102) of a cross-sectional diameter which decreases from the rear end (104) to the front end (106). Use of such a single continuous barrel (102) decreases the probability of air leakage as the air stream travels from the rear end (104) to the front end (106), and produces an air stream of high velocity at the front end (106).

Referring again to FIG. 1, the loading device (20) is mounted above the second barrel (14). The loading device (20) is preferably sufficiently large to contain multiple projectiles (21). In one embodiment, the projectiles (21) are stacked horizontally one on top of the other. A lower surface (25) of the loading device (20) defines an opening (not shown) that is sized to permit only one projectile (21) from passing through at a given time. Likewise, an upper surface of the second barrel (14) defines the opening (22) in alignment with the opening defined by the lower surface (25). The size and shape of the opening (22) on the second barrel (14) will generally be substantially similar to the size and shape of the opening within the lower surface (25) of the loading device (20). During operation of the toy gun (10), the projectiles (21) placed in the loading device (20) are released one at a time into the second barrel (14) through these openings as a result of gravitational force. In one embodiment, the loading device (20) includes a stopper (27) positioned at the top open end of the loading device (20) for retaining the projectiles (21) therein. More specifically, since the air stream which travels down the first barrel (12) and the second barrel (14) also travels upwards into the loading device (20), the stopper (27) serves as a counterweight to force the projectiles down and thereby prevent them from flying out of the loading device (20). It will typically not be desired that the stopper (27) be of relatively large weight, since this may result in undue compression of the projectiles (21) and the resulting frictional forces may hamper effective firing of the projectiles (21). In a particular embodiment, the stopper (27) defines a small opening through which air passes through, thereby preventing the stopper (27) from escaping the loading device (20).

Since multiple projectiles (21) may be simultaneously loaded at one time, the time required to load the toy gun (10) is less than that required to load toy guns configured to accept only a single dart at a time.

In one embodiment, the projectiles (21) are darts that are cylindrical in shape so as to minimize the resistance created as they travel through the barrels (12, 14). In another embodiment, the projectiles (21) are balanced such that they tend to traverse a relatively straight path upon being released from the toy gun (10). In order achieve this objective, the head of each projectile (21) may be made heavier than the remainder of each such projectile (21). That is, the weight of each projectile (21) is distributed such that its center of gravity is located closer to its head end than to its tail end.

Although the projectiles (21) may be fabricated from a variety of relatively light plastic and materials familiar to those skilled in the art, in one particular embodiment each projectile (21) is made of foam. In addition to being light, it is anticipated that projectiles (21) made from would be less prone to cause injury than those made from firmer materials. In an exemplary embodiment the weight of each projectile (21) is approximately 5 grams. Projectiles (21) of heaver or lighter weight may also be employed, it being understood that the speed and distance traveled by the projectiles (21) upon being released from the gun (10) will tend to diminish as their weight is increased.

Figure 5:
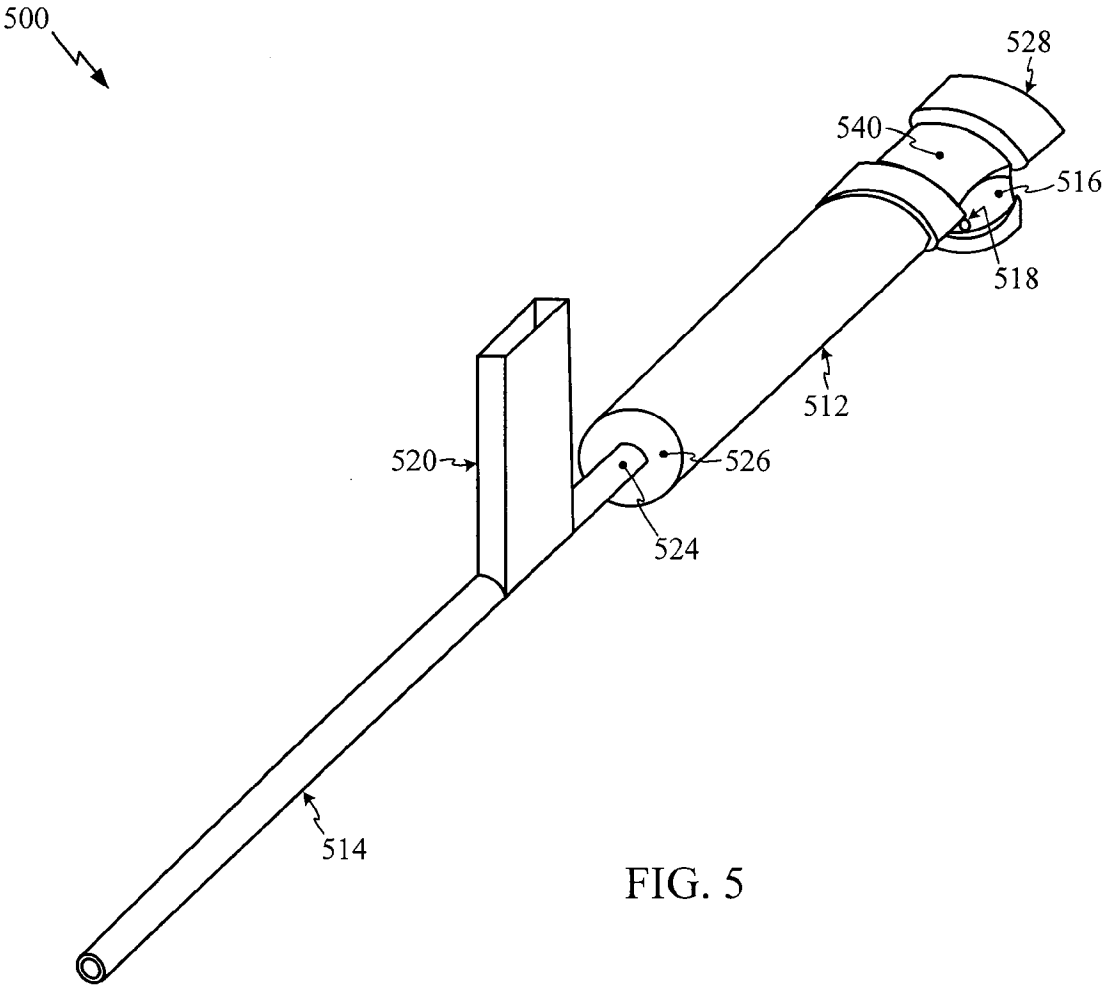
FIGS. 5 and 6 respectively show perspective and cutaway views of an alternate embodiment of the inventive toy gun.
Figure 6:
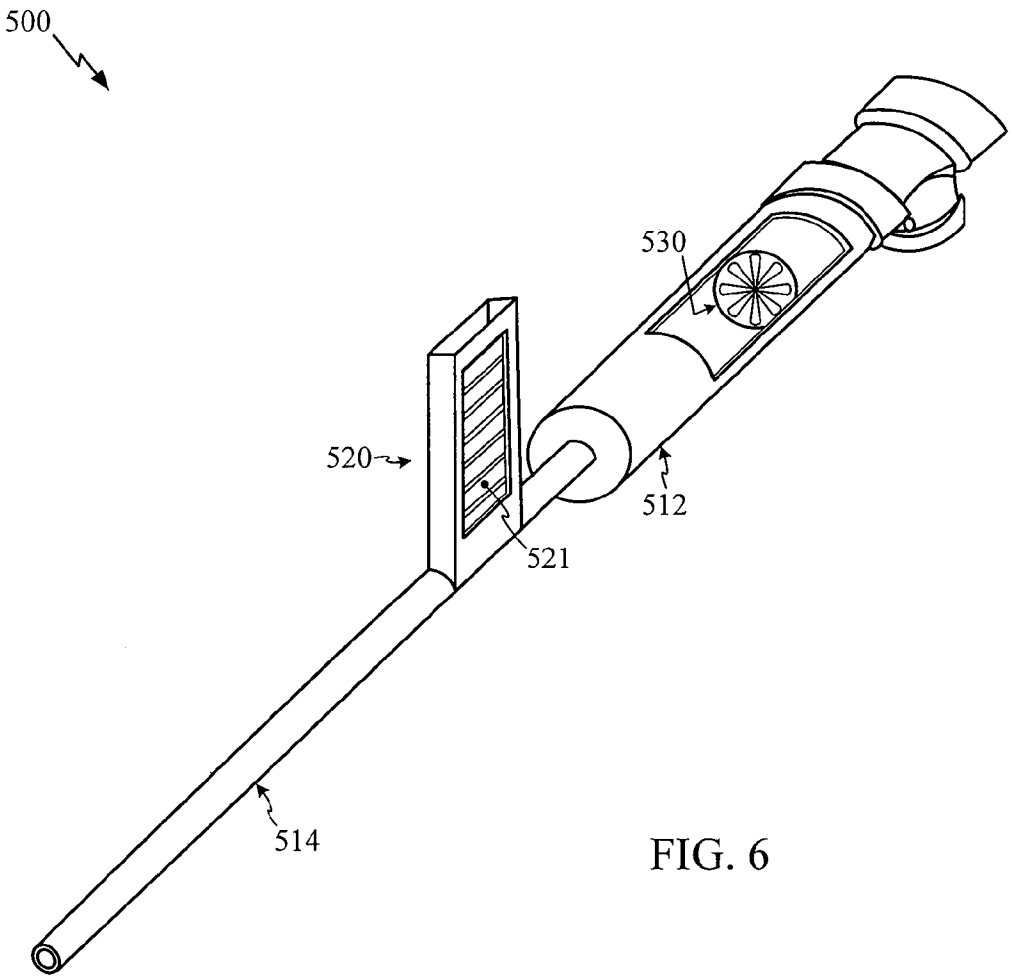

Turning now to FIGS. 5 and 6, there are respectively shown perspective and cutaway views an embodiment of the toy gun (500) which is shaped slightly differently than the embodiments described above. As shown, the toy gun (500) includes a first barrel (512), a second barrel (514), a loading chamber (520), and a handle (516). A forward end (526) of the first barrel (512) mates with the rear end (524) of the second barrel (514). The loading chamber (520) is placed above the second barrel (514), and contains a set of stacked, cylindrical projectiles (521). The handle (516) is positioned below a countered section (540) of the first barrel (512) near its rear end (528). A ducted fan (530) is securely positioned inside the first barrel (512) with the intake end facing towards the rear end (528) of the first barrel (512). As discussed above, pressing of the trigger (518) causes the ducted fan (530) to begin operating and a large volume of air to begin moving through the first barrel (512) and the second barrel (514).

The foregoing description, for purposes of explanation, used specific nomenclature to provide a thorough understanding of the invention. However, it will be apparent to one skilled in the art that the specific details are not required in order to practice the invention. In other instances, well-known devices and components are shown in simplified form in order to avoid unnecessary distraction from the underlying invention. Thus, the foregoing descriptions of specific embodiments of the present invention are presented for purposes of illustration and description. They are not intended to be exhaustive or to limit the invention to the precise forms disclosed, obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the following claims and their equivalents define the scope of the invention.

What is claimed is:

1. A toy gun comprising:

a barrel having a forward end, a rear end, and an inner passage there between;

a fan arranged with respect to the barrel to direct an air stream through the inner passage from the rear end to the forward end;

a loading chamber mounted on the top of the barrel and having an opening directed into the inner passage, wherein the loading chamber is sized and shaped to hold a plurality of projectiles and the opening is sized and shaped to sequentially release a plurality of projectiles into the inner passage of the barrel one at a time, wherein the loading chamber includes a counterweight object placed on the top of the projectiles, wherein the counterweight object has sufficient weight to prevent the projectiles from moving upward when the air stream enters the loading chamber through the opening and forces its way up the loading chamber, and wherein the counterweight object has at least one opening to let a portion of the air stream flow through and around the object to relieve excess air pressure from the loading chamber when there is excess air stream produced by the fan; and a trigger in electrical communication with the fan.

2. The toy gun of claim 1 wherein the fan comprises a ducted fan which includes a motor and further comprising a battery in electrical communication with the trigger and the motor.

3. The toy gun of claim 2 wherein the battery has sufficient power to drive the fan at a speed of greater than 20,000 RPM.

4. The toy gun of claim 1 wherein the forward end of the barrel is smaller in diameter than the rear end of the barrel.

5. The toy gun of claim 4 wherein the diameter decreases gradually from the rear end to the front end of the barrel.

6. The toy gun of claim 4 wherein the loading chamber is sized and shaped to hold a plurality of cylindrical projectiles in a stacked order, wherein the stacked order is a single-file stacked order.

7. The toy gun of claim 1 wherein the loading chamber is sized and shaped to prevent the projectiles from moving upward when the air stream enters the loading chamber through the opening and forces its way up the loading chamber.

8. The toy gun of claim 1 wherein the loading chamber includes an object that is sized and shaped to prevent undue compression of the projectiles in the loading chamber and to prevent the projectiles from moving upward when the air stream enters the loading chamber through the opening and forces its way up the loading chamber.

9. The toy gun of claim 1 wherein the loading chamber and the opening thereof are sized and shaped to release the projectiles into the inner passage of the barrel by gravity force.

10. The toy gun of claim 1 wherein a portion of the inner passage near the fan is divided into multiple passages to even out the air stream directed from the fan.

11. The toy gun of claim 1 wherein the fan generates an air stream sufficient to release the projectiles from the barrel at a rate of greater than 0.5 seconds per projectile.

* * * * *